United States Patent [19]

Faldi

[11] 3,958,346

[45] May 25, 1976

[54] MULTIPLE PUMPING CHAMBER DREDGING APPARATUS

[75] Inventor: Giovanni Faldi, Florence, Italy

[73] Assignee: Pneuma International S.A., Luxembourg, Luxemburg

[22] Filed: July 23, 1974

[21] Appl. No.: 490,962

[30] Foreign Application Priority Data

July 27, 1973 Italy ..... 27228/73

[52] U.S. Cl. ..... 37/59; 417/122

[51] Int. Cl.[2] ..... E02F 3/88

[58] Field of Search ..... 37/58, 59, 72, DIG. 8; 61/69 R, 69 A; 417/122

[56] References Cited

UNITED STATES PATENTS

| | | | |
|---|---|---|---|
| 2,255,167 | 9/1941 | Hunn | 37/58 X |
| 3,455,114 | 7/1969 | Burrus | 61/69 R X |
| 3,518,837 | 7/1970 | Banjavich | 61/69 R |
| 3,624,933 | 12/1971 | Faldi | 37/72 X |
| 3,693,272 | 9/1972 | Gariel | 37/72 X |
| 3,753,303 | 8/1973 | Holzenberger et al. | 37/58 |

*Primary Examiner*—Clifford D. Crowder
*Attorney, Agent, or Firm*—Karl W. Flocks

[57] ABSTRACT

An improved dredging apparatus comprising a plurality of pumping chambers, each pumping chamber having a separate inlet pipe branched off from a single intake duct, the intake duct in turn being either connected to the dredging shovel or directly adapted to take out samples from an underwater bed, the pumping chambers in operation being cyclically filled with dredged material and emptied by air pressure. The pump body is slidably mounted to a rigid frame structure, whereby the intake duct is surrounded and protected during sampling operations.

3 Claims, 3 Drawing Figures

MULTIPLE PUMPING CHAMBER DREDGING APPARATUS

This invention relates to a compressed air pumping apparatus, in particular to an apparatus for dredging and drilling submerged beds.

Various types of compressed air operated pumping and dredging plants are known and used. Among these, for the purposes of the present invention, it is appropriate to mention those which include a submerged pump body comprising at least two pumping chambers, which are alternately filled with mixed material and water, dredged or otherwise withdrawn from the bed, under the thrust of the surrounding water which causes periodical filling of the chambers, which are emptied by the action of the compressed air fed to the chamber to be emptied through a suitable pipe. In this connection reference is made for example to the U.S. Pat. No. 3,791,763.

Each dredged material and compressed air inlet and outlet pipe of each chamber is provided with an isolating valve operated automatically by the air or water pressure respectively.

Downstream of the pumping chambers, the individual outflow pipes join into a single duct for discharging the dredged material at a distance, and a compressor and distributor, normally mounted on board a watercraft which also carries the equipment for raising the pump body, feed compressed air to each pumping chamber in accordance with a predetermined cycle.

In known systems, each chamber is fed with the dredged material by an independent pipe, which may be connected to a shovel for dredging and disgregating the bed.

Obviously each pumping chamber operates discontinuously, because of which the passage of dredged material through the feed pipe of each chamber is intermittent. In some cases, where certain types of submerged bed and dredged material are concerned, this intermittent action is prejudicial because the dredged material demonstrates a certain sluggishness with regard to its conveying into the inlet pipes of the pumping chambers by the force of the surrounding water, especially when the waterhead surrounding the pump body is small.

Another problem which arises in relation to known apparatus is that where the pump serves for withdrawing specimens from the bed and/or for more easily causing the collapse of alternate layers of different compactness.

A more particular case is that of the withdrawal of specimens with the pump resting vertically in the bed, where this is fairly compact. In this case it is easy for the pump to become inclined, so losing its state of perfect verticality.

The main object of the present invention is to obviate the disadvantages and problems briefly mentioned heretofore.

For this object the present invention provides a pumping apparatus for liquids (the term liquids also meaning sludge and mud of high solids content) of the type comprising a submerged pump body consisting of at least two chambers arranged in such manner as to be placed alternately and periodically into communication with a compressed air source by way of a distributor, for each chamber there being provided a pipe for the entry of the dredged material mixed with water, under the thrust of the water surrounding the submerged pump body, and a pipe for the outflow of the dredged material by the action of the compressed air, in which all the inlet pipes to the individual pumping chambers branch from a single intake duct, by which the intake of dredged material through this latter duct takes place without interruption.

In a first embodiment particularly suitable for dredging operations, said intake duct is connected at its free end to a dredging and intake shovel of conventional type, chosen particularly from those according to previous U.S. Patents of the same applicant.

In a second embodiment particularly suitable for withdrawing specimens at different bed layers in drilling operations, the pump body is contained in a tubular housing kept perpendicular to the bed by a trellis frame resting on the bed, said tubular housing being provided internally with means for the vertical sliding of the pump body and of the relative intake duct.

In a modification of this second embodiment, the pump body is rigid with the tubular housing, which in its turn is slidable vertically with respect to the frame, accompanying the pump body and the relative intake duct during the excavation and withdrawal operation, so as to form a protective zone around the mouth of the intake duct.

The details and advantages of the present invention will be more evident from the detailed description given hereinafter by way of non-limiting example, with reference to the accompanying drawings in which.

Figure 1:
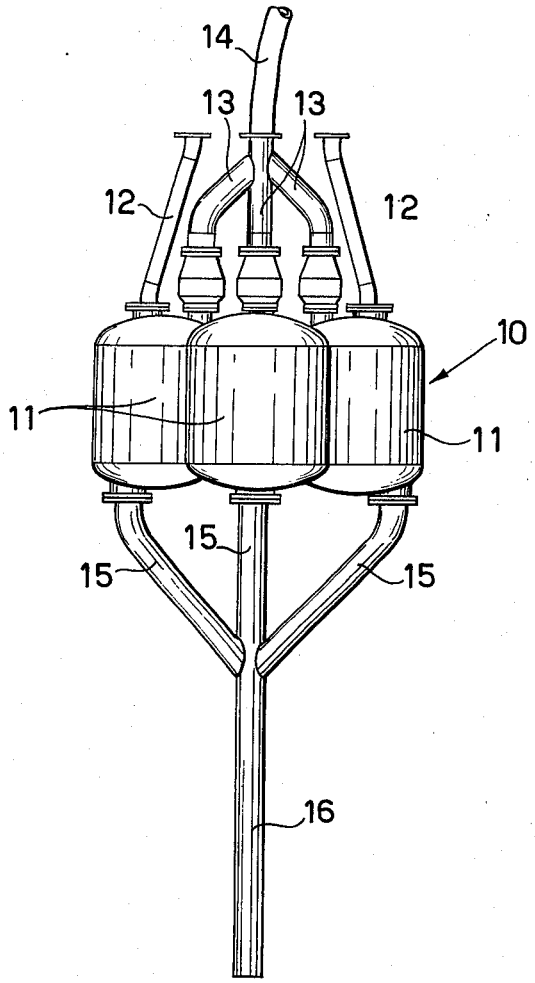
FIG. 1 shows the pump body in accordance with the first described embodiment.

With reference firstly to FIG. 1, this shows a pump body 10 of the type described and illustrated in the U.S. Pat. No. 3,791,763 of the same applicant, comprising three pump chambers 11 fed by compressed air through the pipes 12. The dredged material flows from the pumping chambers through the pipes 13 which converge into the discharge manifold 14, and enters the individual chambers 11 through the corresponding pipes 15 which branch from a single intake duct 16. This latter may be connected at its free end to a dredging shovel of known type.

Where the pump serves for withdrawing specimens or for the localised disgregation of beds, the intake duct is used without further additions to its free end. However in this case, so as to ensure substantially vertical penetration into the bed, one of the modifications shown in FIGS. 2 and 3 is used.

Figure 2:
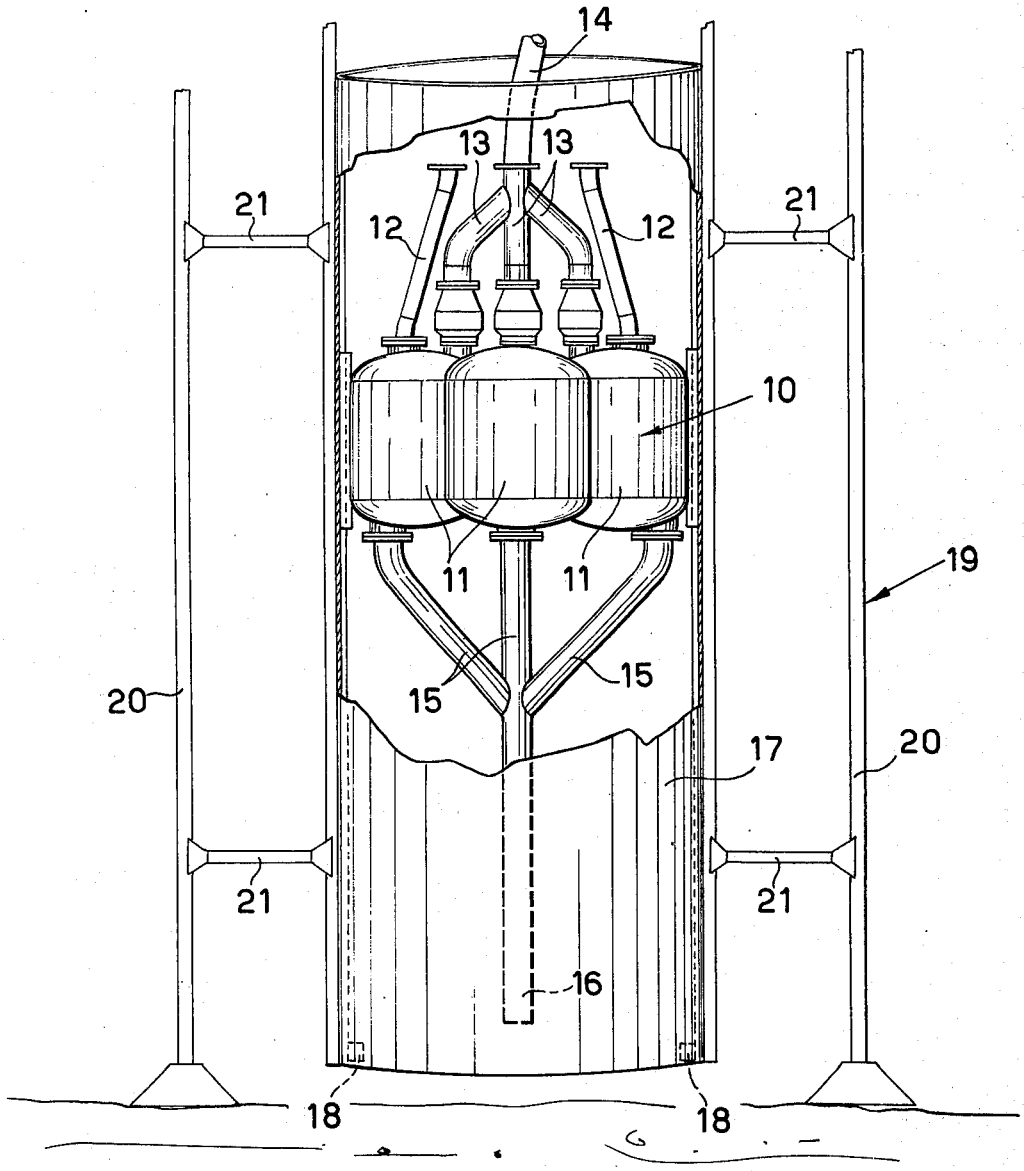
FIG. 2 is a diagrammatic view of the aforementioned second embodiment in its first form.
Figure 3:
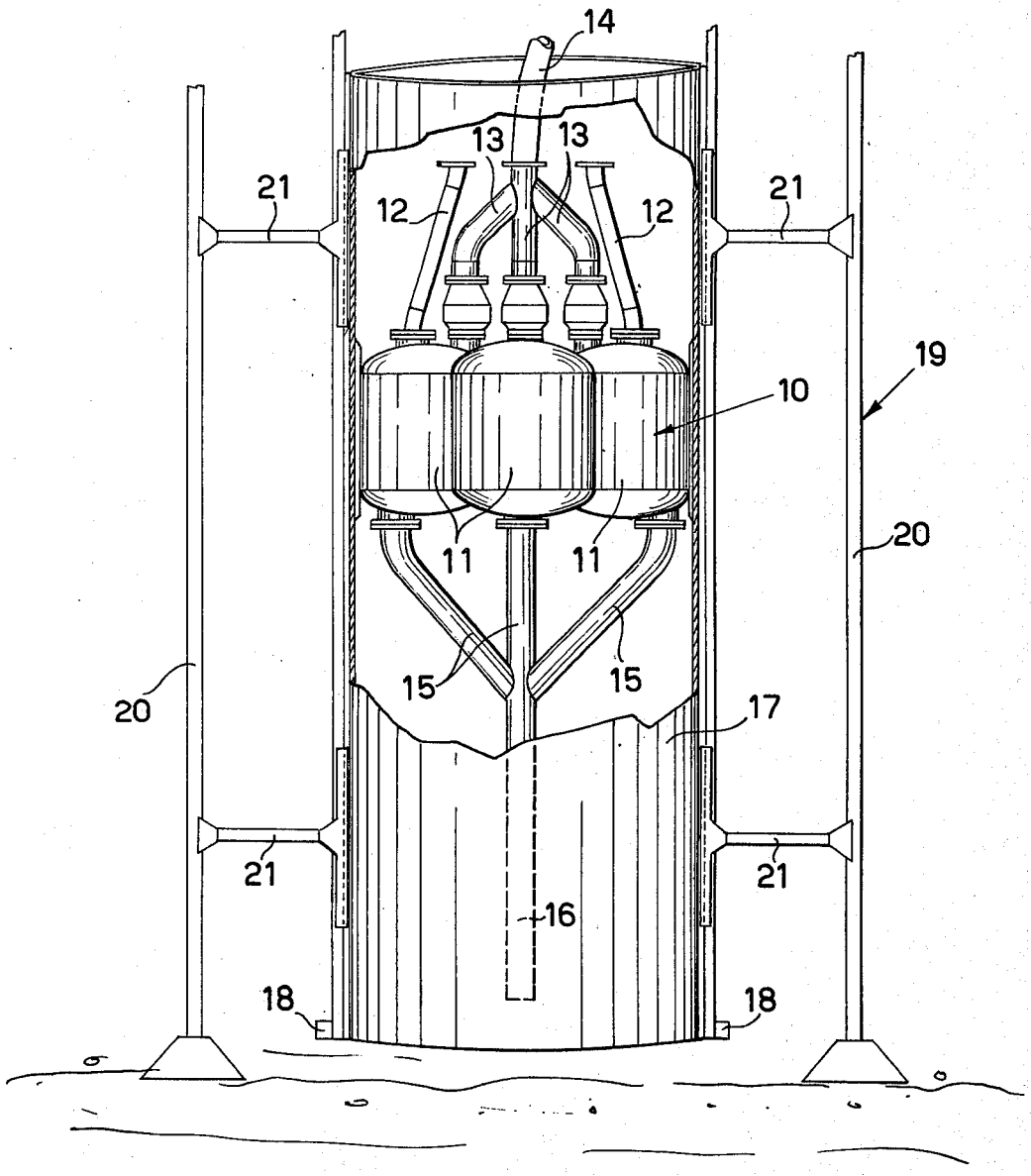
FIG. 3 is a view analogous to FIG. 2 relative to its second form.

In FIG. 2 the pump body 10 is housed slidably by means of vertical slide guides in a tubular housing 17, at the base of which are provided stops 18 for halting the descent of the pump body.

The housing 17 is rigid with a frame 19 formed from three legs, symmetrically positioned, of metal sections 20, which may be telescopic and controllable remotely, and which are connected by horizontal cross pieces 21 to said tubular housing.

For example, each leg can be formed as a pipe acting as a cylinder, in which a piston member is slidably received and oil pressure is controlledly fed from a suitable source (e.g. a source on the boat) through proper connections, the oil pressure being counteracted by a return spring acting on the piston. Electrical levels, mounted to the frame 19, originate control signals for the controlled feeding of oil pressure to each leg.

These legs are disposed at a distance apart which is proportional to the depth of the withdrawal to be made, so as to avoid alterations in the verticality of the apparatus due to the collapse of the bed during dredging.

The modified embodiment of FIG. 3 comprises the same components as that of FIG. 2, but in this case the pump body 10 is rigid during withdrawal with the tubular housing 17, which is slidable with respect to the frame 19, so that the intake duct is constantly screened and protected by the tubular housing. It is to be pointed out that the intake pipe 16 can be either of rigid or of at least partially flexible structure, depending on the necessities of the operation to be carried out and/or on the nature of bed.

The invention has been described in relation to some preferred embodiments, but conceptually equivalent modifications may be made without leaving its scope.

What is claimed is:

1. Apparatus for sample removal from underwater beds and/or dredging of loose beds in which adjacent soil would be likely to slide down into the dredged area, said apparatus comprising a submersible pump body including at least two pumping chambers, air intake pipe means connected to each of said pumping chambers, said air intake pipe means being connected to a comprssed air source through distributor means for alternately and periodically supplying compressed air to said pumping chambers to effect pumping therein, a separate pipe connected to each of said pumping chambers for introducing dredged material mixed with water therein under the waterhead acting on the submersible pump body and a pipe for the outflow of dredged material connected to each of said pumping chambers, each of said pipes for the outflow of dredged material converging and being connected to a single manifold discharge pipe, each of said separate pipes for introducing dredged material into said pumping chambers also being connected to and diverging from a single intake duct whereby under the action of compressed air intake of dredged material may be effected continuously and without interruption through said single intake duct and alternately through each of said separate pipes for introducing dredged material into said pumping chambers, alternately through said pumping chambers and an outflow pipe connected thereto, and continuously and without interruption through said single manifold discharge pipe, a tubular housing containing said pump body and a trellis frame supporting said tubular housing and adapted to rest on the bed to keep said tubular housing and said pump body perpendicular to the bed, said pump body being slidable vertically with respect to said frame.

2. Apparatus as claimed in claim 1, in which said tubular housing is rigidly fixed to said frame.

3. Apparatus as claimed in claim 1, in which said tubular housing is slidable vertically and rigid with the pump body with respect to said frame.

* * * * *